US008163807B2

(12) United States Patent
Katsuhara et al.

(10) Patent No.: US 8,163,807 B2
(45) Date of Patent: Apr. 24, 2012

(54) BLENDING APPARATUS, BLENDING METHOD, PHASE INVERSION EMULSIFYING METHOD, AND METHOD FOR PRODUCING RESIN PARTICLE DISPERSION

(75) Inventors: Hideya Katsuhara, Kanagawa (JP); Hiroyuki Moriya, Kanagawa (JP); Tomohito Nakajima, Kanagawa (JP); Kazuya Hongo, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 282 days.

(21) Appl. No.: 12/429,007

(22) Filed: Apr. 23, 2009

(65) Prior Publication Data

US 2010/0125106 A1 May 20, 2010

(30) Foreign Application Priority Data

Nov. 18, 2008 (JP) ..... 2008-294686

(51) Int. Cl.
*B01F 5/06* (2006.01)

(52) U.S. Cl. ..... 516/53; 516/99; 366/76.2; 366/76.5; 366/76.93

(58) Field of Classification Search ..... 516/53, 516/99; 366/76.2, 76.5, 76.93
See application file for complete search history.

(56) References Cited

U.S. PATENT DOCUMENTS

| | | | |
|---|---|---|---|
| 2006/0231963 | A1 | 10/2006 | Ohshima et al. |
| 2007/0077185 | A1 | 4/2007 | Ueyama et al. |

FOREIGN PATENT DOCUMENTS

| | | | |
|---|---|---|---|
| JP | U-38-17852 | | 8/1963 |
| JP | 50-091062 | * | 7/1975 |
| JP | B-50-91062 | | 7/1975 |
| JP | A-52-135308 | | 11/1977 |
| JP | A-53-72015 | | 6/1978 |
| JP | A-55-35901 | | 3/1980 |
| JP | U-55-73230 | | 5/1980 |
| JP | 59-154328 | * | 10/1984 |
| JP | U-59-154328 | | 10/1984 |
| JP | 60-220287 | * | 11/1985 |
| JP | A-60-220287 | | 11/1985 |
| JP | A-11-209477 | | 8/1999 |
| JP | A-11-347460 | | 12/1999 |
| JP | A-2004-255367 | | 9/2004 |
| JP | A-2007-98223 | | 4/2007 |
| JP | A-2007-133093 | | 5/2007 |
| JP | A-2008-80257 | | 4/2008 |

OTHER PUBLICATIONS

Office Action issued in Japanese Patent Application No. 2008-294686 mailed on Aug. 17, 2010. (with English-language Translation).

* cited by examiner

*Primary Examiner* — Ling Choi
*Assistant Examiner* — Chun-Cheng Wang
(74) *Attorney, Agent, or Firm* — Oliff & Berridge, PLC

(57) ABSTRACT

A blending apparatus is provided, the blending apparatus including: an outer tube; and at least one inner tube disposed inside the outer tube, wherein a distal end, in a lengthwise direction, of the inner tube is located at an intermediate position, in a lengthwise direction, of the outer tube, and the inner tube has plural of through holes in a vicinity of the distal end thereof.

5 Claims, 3 Drawing Sheets

BLENDING APPARATUS, BLENDING METHOD, PHASE INVERSION EMULSIFYING METHOD, AND METHOD FOR PRODUCING RESIN PARTICLE DISPERSION

CROSS-REFERENCE TO RELATED APPLICATIONS

This application is based on and claims priority under 35 U.S.C. 119 from Japanese Patent Application No. 2008-294686 filed Nov. 18, 2008.

BACKGROUND

1. Technical Field

The present invention relates to a blending apparatus, a blending method, a phase inversion emulsifying method, and a method for producing resin particle dispersion.

2. Related Art

With respect to a minute particle producing method and a micro chemical apparatus used for the producing method, some patent documents are publicly released.

The method for non-continuously producing minute particle dispersion is diversified. However, a phase inversion emulsifying method has been known as one thereof.

In the phase inversion emulsifying method, an emulsion (for example, a W/O (water-in-oil) type fluid dispersion) in which the combination of continuous phase and dispersion phase being an object is inverse is first prepared. Next, by inverting the phase when reaching the critical point by executing an operation such as increasing the volume of the dispersion phase, an emulsion of the target type (for example, an O/W (oil-in-water) type fluid dispersion) is prepared. Since, in this system, coalescence and micronization are simultaneously brought about by shearing and blending of the dispersion phase, uniformity of the system is important.

SUMMARY

According to an aspect of the present invention, there is provided a blending apparatus including: an outer tube; and at least one inner tube disposed inside the outer tube, wherein a distal end, in a lengthwise direction, of the inner tube is located at an intermediate position, in a lengthwise direction, of the outer tube, and the inner tube has plural of through holes in a vicinity of the distal end thereof.

BRIEF DESCRIPTION OF THE DRAWINGS

Exemplary embodiment of the present invention will be described in detail based on the following figures, wherein.

DETAILED DESCRIPTION

Hereinafter, a description is given of exemplary embodiments of the present invention.

A blending apparatus according to the present invention is featured in that the blending apparatus includes an outer tube and at least one inner tube disposed inside the outer tube, the distal end in the lengthwise direction of the inner tube is located at an intermediate position in the lengthwise direction of the outer tube, and the inner tube is provided with plural through holes in the vicinity of the distal end thereof.

Hereinafter, a description is given of a blending apparatus according to the present invention with reference to the drawings.

Figure 1A:
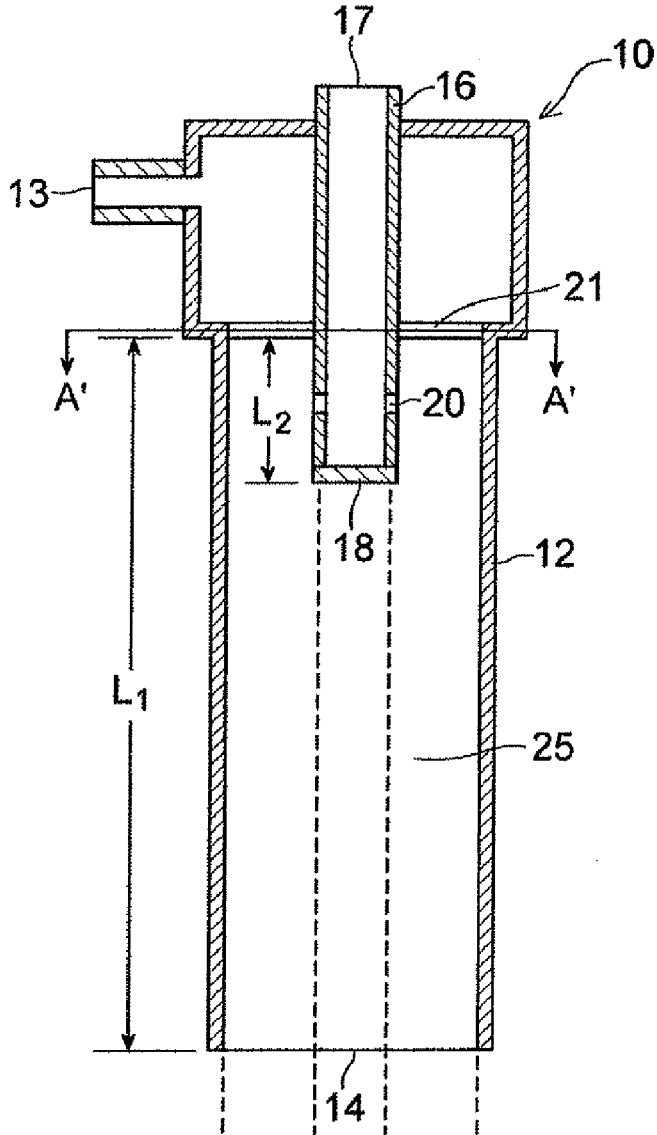
FIG. 1A is sectional view showing the interior of one example of a blending apparatus according to the present exemplary embodiment.
Figure 1B:
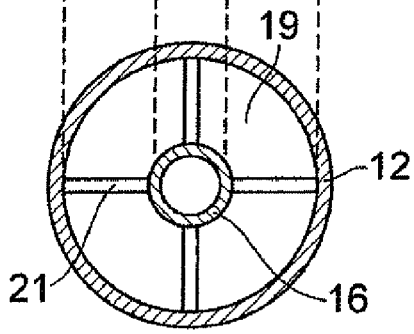
FIG. 1B is a sectional view taken along the line A'-A' of FIG. 1A.

FIG. 1A is a sectional view showing the inner structure of one example of a blending apparatus according to the present exemplary embodiment, and FIG. 1B is a sectional view taken along the line A'-A' of FIG. 1A.

A blending apparatus 10 according to the present invention is formed to be cylindrical as the entirety and includes one outer tube 12 and at least one inner tube 16 disposed inside the outer tube 12.

The sectional shape of the outer tube and the inner tube is optional, wherein a circular, square or polygonal shape is preferred, and it is further preferable that the shapes of the outer tube and the inner tube are similar to each other. It is particularly preferable that the shapes thereof are circular. Hereinafter, the inner diameter of the outer tube or the inner tube means an equivalent diameter.

The equivalent diameter is also called a "hydraulic diameter," which is a term used in the field of mechanical engineering. When an equivalent circular tube is assumed with respect to a pipe (a passage in the present invention) of an optional sectional shape, the diameter of the equivalent circular tube may be referred to as an equivalent diameter. The equivalent diameter ($d_{eq}$) is defined to be $d_{eq}=4A/p$ using a sectional area A of the pipe and a wetted perimeter length (peripheral length) p of the pipe. Where applied to a circular tube, the equivalent diameter matches the circular tube diameter. The equivalent diameter is used to estimate fluidity or thermal transmission characteristics of a tube based on the data of the equivalent circular tube, and expresses a spatial scale (representative length) of phenomenon. The equivalent diameter becomes $d_{eq}=a$ in terms of a regular square tube one side of which is a.

The equivalent diameter (inner diameter) of the inside of the outer tube 12 is greater than the equivalent diameter (outer diameter) of the outside of the inner tube 16. Although the inner diameter of the outer tube 12 may be appropriately selected, it is preferable that the inner diameter thereof is 0.1 to 10 mm, and it is further preferable that the inner diameter thereof is 0.5 to 5 mm. At least one inner tube 16 is disposed in the interior of the outer tube 12. Although the number of the inner tubes 16 disposed in a single outer tube 12 may be one to 10 tubes, it is also preferable that one inner tube is disposed therein. If the outer tube 12 and the inner tube 16 are, respectively, single, it is preferable that both the tubes are coaxially disposed.

Although the outer diameter of the inner tube 16 may be selected to be an optional dimension smaller than the inner diameter of the outer tube 12, it is preferable that the outer diameter of the inner tube 16 is approximately one-tenth to approximately two-thirds of the inner diameter of the outer tube 12, further preferably one-fifth through one-half thereof.

The inner tube 16 may compose an inner tube passage, and has an inner tube supply port 17 and plural through holes 20 being liquid ejection ports in the vicinity of the distal end in the lengthwise direction thereof. The vicinity of the distal end means an area between the inner tube distal end 18 and a place apart by three times the equivalent diameter of the inner tube from the distal end of the inner tube. In order to reduce the dead space, it is preferable that some of the through holes are located in an area between the distal end and a place apart by two times the equivalent diameter of the inner tube from the distal end. Although the number of the through holes 20 may be appropriately selected, two to 10 through holes are preferable, and four to eight through holes are further preferable. It is preferable that the aperture shape of the through hole 20 is circular in terms of ease in machining while the shape thereof may be optional. Further, the size of the aperture of the through hole 20 may be appropriately selected. In order to machine a necessary quantity of through holes in the vicinity of the distal end of the inner tube, it is preferable that the equivalent diameter of the through hole is 0.1 to 0.8 times the equivalent diameter of the inner tube, further preferably 0.3 to 0.6 times.

Figure 2A:
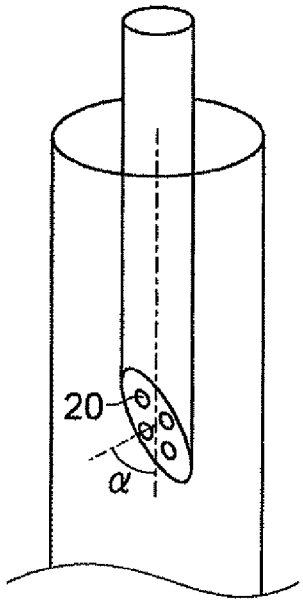
FIGS. 2A to 2D are conceptual enlarged views showing examples of through holes in a blending apparatus according to the present exemplary embodiment.
Figure 2B:
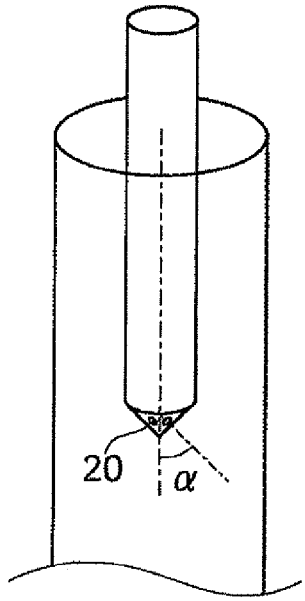
Figure 2C:
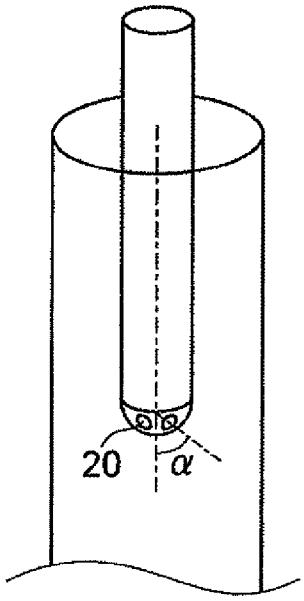
Figure 2D:
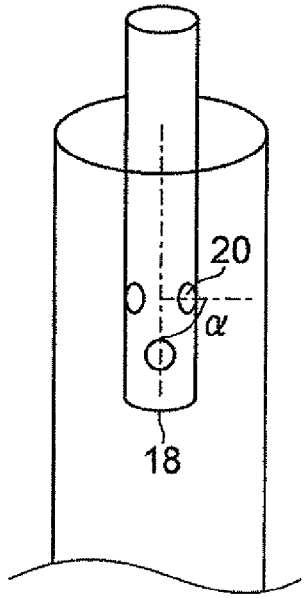

The perpendicular direction of the aperture plane of the through holes 20 may be established in various directions with respect to the lengthwise direction of the inner tube. Also, the lengthwise direction of the inner tube 16 is equivalent to the axial direction where the inner tube 16 is straight. The through holes 20 may be provided in a circular or elliptical flat end plate with the distal end 18 of the inner tube sealed. It is preferable that, as shown in FIG. 2D, the through holes 20 are provided in the inner tube 16 perpendicular to the axial direction of the inner tube in the vicinity of the distal end 18 of the inner tube in a state where the distal end 18 of the inner tube is sealed. The through holes may be provided in multiple stages. For example, the through holes are arrayed three by three with an interval of 120° alternately in upper and lower stages, and six through holes in total may be provided.

In addition, the inner tube 16 is fixed in the interior of the outer tube 12 via support frames 21.

The distal end 18 of the inner tube 16 is located at an intermediate position in the lengthwise direction of the outer tube 12. Although the relative lengths of the inner tube 16 and the outer tube 12 may be optionally selected, it is preferable that the distal end 18 of the inner tube is located at an intermediate position of the length $L_1$ of the outer tube and is apart from the distal end 14 of the outer tube by a comparatively long distance. It is preferable that the length $L_2$ of the inner tube is one-half or less of the length $L_1$ of the outer tube, further preferably 1/20 to 1/4. In the present exemplary embodiment, where plural inner tubes 16 are provided in one outer tube 12, any one of the distal ends in the lengthwise direction of all the inner tubes 16 is located at an intermediate position in the lengthwise direction of the outer tube 12. Where plural inner tubes 16 are provided, it is not necessary that the lengths $L_2$ thereof are the same with respect to the lengthwise direction of the outer tube 12. Rather, it is preferable that the lengths $L_2$ thereof slightly differ from each other in the lengthwise direction of the outer tube, and the positions of the through holes 20 are determined at distances differing from each other per inner tube.

The supply port 17 of the inner tube 16 is connectable to a liquid feeding unit.

Also, space in which an outer-circumferential passage 19 is composed is provided between the outer tube 12 and the inner tube 16. The supply port of the outer-circumferential passage 19, that is, the outer tube supply port 13 is connectable to the liquid feeding unit. The outer-circumferential passage 19 is made confluent to the through hole 20 provided in the vicinity of the distal end of the inner tube 16, and composes a confluent passage 25 and reaches a single outer tube ejection port 14.

Figure 3:
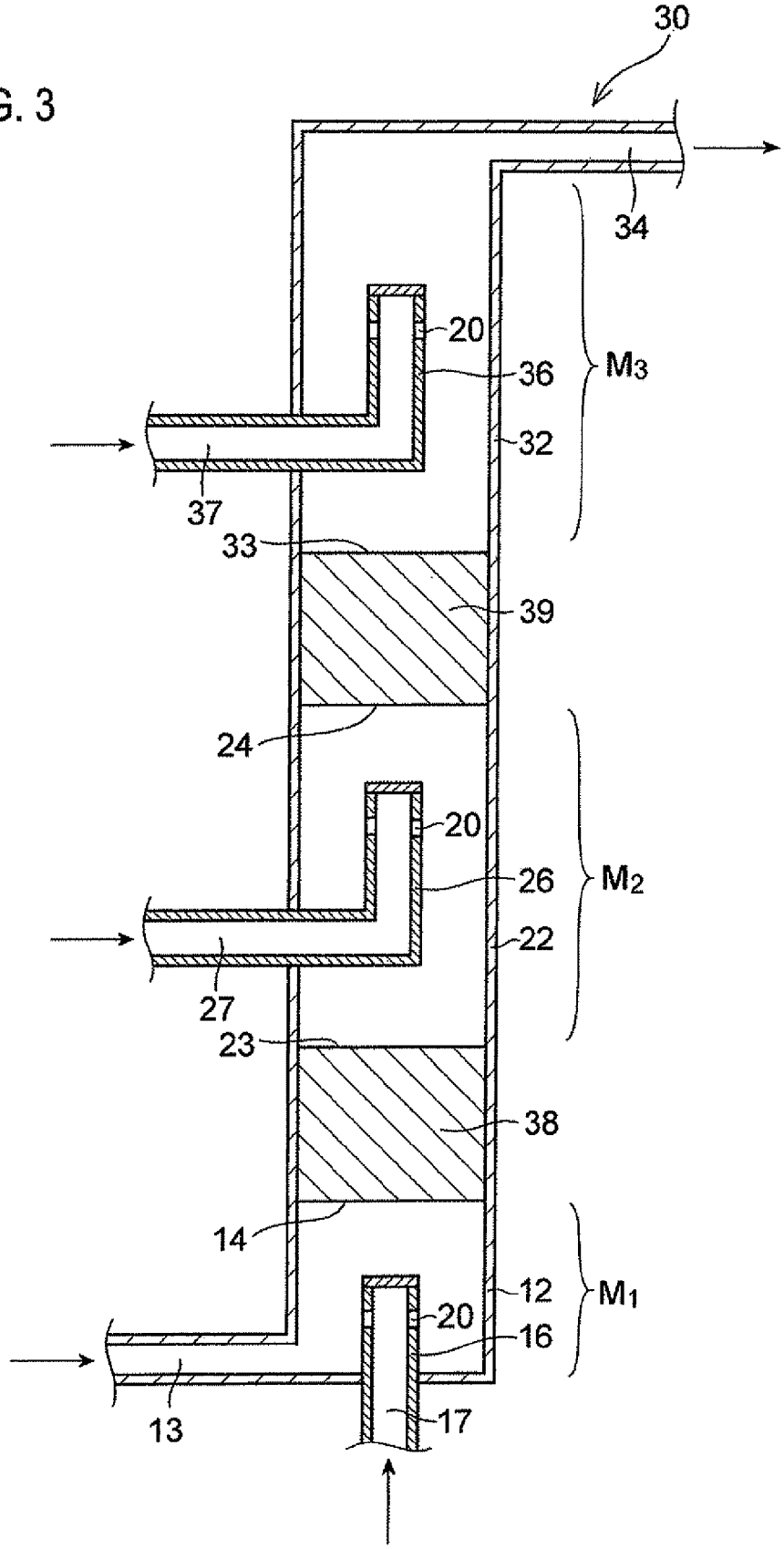
FIG. 3 is a schematic conceptual view showing one example of a three-stage blending apparatus.

As an exemplary embodiment, in a blending apparatus connected in series in multiple stages as shown in FIG. 3, it is preferable that the outer tube ejection port of a preceding-stage blending apparatus is connected to the outer tube supply port of a subsequent blending apparatus. In addition, it is preferable that a blending mixer is provided at an intermediate position between the preceding stage and the subsequent stage.

Further, the material of the outer tube and the inner tube is not particularly limited. For example, metal, synthetic resin, glass, etc., may be listed. A glass tube, a quartz glass tube, etc., may be preferably used because these do not react with many liquids and the interior thereof can be observed from outside.

As already described, the inner tube is provided with plural of through holes in the vicinity of the distal end thereof.

FIGS. 2A to 2D are conceptually enlarged views showing a detailed example of through holes in a blending apparatus according to the present exemplary embodiment.

FIGS. 2A to 2D show enlarged views of following detailed examples (1) to (4), respectively.

As detailed examples, (1) a case where plural through holes are provided perpendicularly to an elliptical flat end plate that diagonally seals the distal end in the lengthwise direction of the inner tube (FIG. 2A), (2) a case where plural through holes are provided perpendicularly to a conical surface in a cone that conically seals the distal end in the lengthwise direction of the inner tube (FIG. 2B), (3) a case where plural through holes are provided perpendicularly to the semi-spherical surface in a semi-sphere that semi-spherically seals the distal end in the lengthwise direction of the inner tube (FIG. 2C), and (4) a case where, as already described, plural through holes are provided perpendicularly to the axial direction of the inner tube in the vicinity of the distal end in a state where the distal end in the lengthwise direction of the inner tube is sealed to be like a circular plate, may be exemplarily shown. The pattern of FIG. 2D is preferable in terms of ease in machining.

Where the angle formed by the perpendicular direction (normal line to an aperture plane) of a through hole and the axial direction (the flowing direction) of the inner tube is regarded as $\alpha$, it is preferable that $\alpha$ is provided so as to satisfy the relational expression of $0° < \alpha \leqq 90°$.

In plural through holes shown in FIGS. 2A to 2D, $\alpha = 90°$ is brought about each of plural through holes in FIG. 2D.

It is preferable that a blending apparatus according to the present exemplary embodiment includes a temperature-controller that controls the temperature of the outer tube and/or the inner tube. It can be exemplarily illustrated as a controller that controls the temperature that the entirety of the blending apparatus is immersed in a (warm) bath the temperature of which is adjusted. The controlling temperature may be optionally selected, and the temperature may be set to a desired temperature in a range from 0° C. to 95° C. In a case of a multi-stage blending apparatus, the controlling temperatures of the respective stage blending apparatus may be set so as to differ from each other.

The blending apparatus according to the present exemplary embodiment may include rotator that rotates the inner tube. In this case, the inner tube may be rotated in a given direction with the outer tube fixed, or the inner tube may be periodically rotated clockwise or counterclockwise.

As another exemplary embodiment, two or more of the blending apparatuses described in any one of exemplary embodiments of the present invention mentioned above may be connected in series to fabricate a multiple-stage blending apparatus (a blending system).

In this case, such a blending apparatus may be exemplarily illustrated, in which a blending apparatus described in any one of exemplary embodiments of the present invention mentioned above is connected in series in multiple stages, and the outer tube ejection port of the first-stage blending apparatus is connected to the outer tube supply port of the second-stage blending apparatus, and which includes a liquid feeding unit for feeding a fluid, preferably a common liquid, in the inner tube passage of the first-stage blending apparatus and the inner tube passage of the second-stage blending apparatus.

FIG. 3 is an schematic conceptual view showing a three-stage blending apparatus as one example of the multiple-stage blending apparatus. The three-stage blending apparatus 30 is such that three blending apparatuses $M_1$, $M_2$ and $M_3$ are connected in series. It is preferable that a blending mixer is inserted between $M_1$ and $M_2$ and between $M_2$ and $M_3$, respectively. $M_1$, $M_2$ and $M_3$ are composed by combining outer tubes 12, 22, 32 and inner tubes 16, 26, 36 one by one together, and plural through holes 20 are provided in the vicinity of the distal ends of the inner tubes 16, 26, and 36.

Further, there is no special limitation with respect to the number of stages of the multi-stage blending apparatus. However, three or more stage blending apparatus is preferable. A three to five stage blending apparatus is further preferable.

As described in detail later, the blending apparatus according to the present exemplary embodiment may be used to non-uniformly blend organic solvent solution and water-soluble solution by feeding a resin, preferably a synthetic resin, organic solvent solution to the outer tube supply port of the blending apparatus and feeding water or water-soluble solution, which is slightly compatible to the organic solvent solution, into the inner tube. The "water-soluble solution" means a mixture of water and water-miscible organic solvent.

As shown in FIG. 3, it is preferable that a blending mixer 38 is provided between the outer tube ejection port 14 of the first-stage blending apparatus and the outer tube supply port 23 of the second-stage blending apparatus in the multi-stage blending apparatus according to the exemplary embodiment of the present invention. Also, it is preferable that a blending mixer 39 is provided between the outer tube ejection port 24 of the second-stage blending apparatus and the outer tube supply port 33 of the third-stage blending apparatus. This is the same in the case of the third or more-stage blending apparatus.

The blending mixer may be appropriately selected. However, a static in-tube mixer is preferred. For example, a micro hi-mixer (registered trade name) developed and marketed by Toray Engineering Co., Ltd. is available. There are two modules, 5-element type and 10-element type, in regard to the micro hi-mixer. Either one may be used.

By using the blending mixer, micronization and uniformity of the dispersion phase may be accelerated with respect to W/O (water-in-oil) type fluid dispersion or O/W (oil-in-water) type fluid dispersion.

A blending apparatus or a multi-stage blending apparatus described in any one of exemplary embodiments of the present invention described above may be used for a blending method for obtaining a W/O type fluid dispersion. A blending method according to the present exemplary embodiment is featured in that the method includes a step of preparing a blending apparatus or a multi-stage blending apparatus described in any one of exemplary embodiments of the present invention described above, and a step of feeding a resin organic solvent solution to the outer-circumferential passage located between the outer tube and the inner tube of the first-stage blending apparatus, feeding water or water-soluble solution to the inner tube passage, and obtaining a W/O type fluid dispersion at the confluent passage.

Herein, the W/O type fluid dispersion means fluid dispersion in which liquid drops consisting of water and/or water-soluble constituents are dispersed in a continuous phase consisting of lipophilic constituents. Also, the O/W type fluid dispersion means fluid dispersion in which liquid drops consisting of lipophilic constituents are dispersed in a continuous phase consisting of water and/or water-soluble (water-miscible) constituents.

An organic solvent solution of resin, preferably, synthetic resin, further preferably, hydrophobic synthetic resin may be exemplarily listed as the lipophilic constituent. Here, the organic solvent includes a hydrophobic organic solvent, or a mixture of a hydrophobic organic solvent and a water-miscible solvent. Ion-exchanged water is preferred as water, and a mixture of water and a water-miscible organic solvent may be listed as the water-soluble constituent.

A description is given below of a synthetic resin and a hydrophobic organic solvent.

(Resin)

Synthetic resin is preferable as resin that can be used in the present exemplary embodiment. Hydrophobic synthetic resin is further preferred. For example, α-olefin (co)polymer such as polyethylene, polypropylene, etc.; aromatic ethylenically unsaturated compound polymer such as polystyrene, α-polymethyl styrene, etc.; (metha)acrylic acid ester polymer such as polymethyl(metha)acrylate, etc.; polyamide resin; polycarbonate resin; polyether resin; polyester resin and copolymer resin thereof may be listed. Aromatic ethylenically unsaturated compound polymer, (metha)acrylic acid ester and styrene copolymer resin, and polyester resin are preferred as synthetic resin. With respect to these resins, an individual polymer may be used or two or more types of polymers may be concurrently used. In addition, a random copolymer and block copolymer may be independently used, or two or more types of copolymers may be concurrently used. These synthetic resins are usefully used as a binding resin of toner for development of an electrostatic charged image in terms of charge stability and development durability.

(Hydrophobic Organic Solvent)

The organic solvent is a hydrophobic organic solvents for dissolving the synthetic resins described above, preferably the hydrophobic synthetic resins. Aqueous organic solvents having miscibility to water may be concurrently used with the hydrophobic organic solvents.

The hydrophobic organic solvent includes formates, acetate esters, butyrates, ketones, ethers, benzenes, halocarbons, etc. In detail, esters with lower alcohol such as formate, acetate ester, butyrate, etc., methyl lower-alkyl ketones such as acetone, MEK (methyl ethyl ketone), MPK (methyl propyl ketone), MIPK (methyl isopropyl ketone), MBK (methyl butyl ketone), MIBK (methyl isobutyl ketone), etc., ethers such as diethyl ether, diisopropyl ether, etc., aromatic series solvents such as toluene, xylene, benzene, etc., halocarbons such as carbon tetrachloride, methylene chloride, 1,2-dichloroethane, 1,1,2-trichloroethane, trichloroethylene, chloroform, monochlorobenzene, dichloroethylidene, etc., may be used independently or by combination of two or more types mentioned above. Acetates (ethyl acetate) and methyl lower-alkyl ketones (methyl ethyl ketone) having a low boiling point, which do not have halogen atoms and are slightly compatible with water, may be preferably used in view of easiness to procure, easy collection when being distilled off, and attention to the environment. Also, it is preferable that a slight amount of a water-soluble organic solvent such as isopropyl alcohol, etc., is used along with these hydrophobic organic solvents.

(Water-Soluble Organic Solvent)

It is preferable that a slight amount of water-soluble organic solvent is used along with the hydrophobic organic solvent.

As a water-soluble organic solvent, lower alcohols such as methanol, ethanol, 1-propanol, 2-propanol, 1-butanol, 2-butanol, t-butanol, and 1-pentanol, etc.; ethylene glycol monoalkyl ethers such as ethylene glycol monomethyl ether, ethylene glycol monoethyl ether, ethylene glycol monobutyl ether, etc.; ethers; dials; THF (tetrahydrofuran), etc., may be listed. 2-propanol (isopropyl alcohol) is preferred as the water-soluble organic solvent.

A water-soluble organic solvent may be added to a resin solution. In this case, it is preferable that the use amount of water-soluble organic solvent is 5% to 30% by volume of the hydrophobic organic solvent, further preferably 10% to 20% by volume. Also, it does not matter that a water-soluble organic solvent is mixedly used in an ion-exchanged water.

Where the water-soluble solution is composed of (ion-exchanged) water and a water-soluble organic solvent, it is preferable that the content of the water-soluble organic solvent in the water-soluble solution is 1% to 50% by weight, further preferably 1% to 30% by weight.

(Difference in Viscosity)

Where plural fluids the viscosities of which are different from each other is continuously mixed, the inventor et. al. found that clogging occurs in the distal end of the inner tube, using a blending apparatus of double tubes. In detail, where an organic solvent solution of synthetic resin is mixed with water that becomes a poor solvent of the synthetic resin by using a double tube in which the inner tube is opened to be circular at the distal end thereof, resin is deposited at the distal end of the inner tube which is the confluent portion, and the inner tube is blocked as a result. It is presumed that this is because the viscosity of water is low although the viscosity of the organic solvent solution of synthetic resin is high, and the difference in static viscosity between both liquids is 50 mPa·s or more.

The blending method according to the present exemplary embodiment is preferably used in a case where two liquids in a combination in which the difference in static viscosity between both liquids is 50 mPa·s or more, further preferably, 100 to 500 mPa·s when blending an organic solvent solution of resin (resin solution) with a poor solvent (water) in regard to the resin.

(Phase Inversion Emulsification)

A blending apparatus, preferably a multi-stage blending apparatus according to the present exemplary embodiment may be used to invert phases and emulsify an organic solvent solution of resin, preferably a hydrophobic (lipophilic) organic solvent solution of synthetic resin. Furthermore, the blending apparatus may produce a resin particle dispersion by inverting phases and emulsifying and thereafter carrying out a step of extracting an organic solvent, to water or a water-soluble solution, from a dispersion of organic solvent solution and subsequently continuing a step of obtaining an aqueous dispersion of resin.

The phase inversion emulsifying step is a step of obtaining an O/W type fluid dispersion by first obtaining a W/O type fluid dispersion with a slight amount of water added to an organic solvent solution of a synthetic resin, etc., thereafter stepwise increasing the addition amount of water and inverting the phase thereof.

Where a multi-stage blending apparatus of three stages is used, a W/O type fluid dispersion is produced by adding water to a resin solution in the first-stage blending apparatus, and the W/O type fluid dispersion can be phase-inverted to an O/W type fluid dispersion in the second-stage or third-stage blending apparatus, preferably in the third-stage blending apparatus.

However, in a so-called phase inversion emulsifying method of a batch system in which blending is carried out in a vessel, shearing and blending operations become difficult in line with an increase in scale of emulsification, wherein unevenness occurs in the system of emulsification. It is considered that this is because the timings to reach the critical point for phase inversion differ from each other, depending on places of the system subjected to phase inversion emulsification. It can be presumed that, since a difference is brought about in the timing, places where coalescence and micronization are further brought about occur, wherein the system of phase inversion emulsification is disordered, resulting in a disorder in phase-inverted substance.

Where phase inversion emulsification is carried out, it is preferable that water or water soluble solution is stepwise added to an organic solvent solution of resin (resin solution) by using a multi-stage blending apparatus, further preferably ion-exchanged water is added thereto. It is preferable that the total amount of water added is 0.8 to 3 times the volume of the resin solution, further preferably 1.0 to 2.0 times.

It is preferable that the amount of resin solid content of the resin solution is 10 to 60 grams for 100 milliliter of the resin solution, further preferably 30 to 50 grams. In this case, the total amount of water for phase inversion emulsification is preferably approximately 2 times or more the amount of resin, further preferably 2.0 to 3.0 times.

Although the amount of addition of water may be appropriately selected where a three-stage blending apparatus is used, it is preferable, as one example, that water is supplied in the inner tube by 20 to 65 parts by volume for a unit time in the first stage with respect to a resin solution of 100 parts by volume, which is supplied in the outer-circumferential passage (outer tube) for a unit time, and water of 40 to 60 parts by volume is further preferably supplied.

Also, it is preferable that, in the second-stage blending apparatus, the entire amount of W/O type fluid dispersion ejected from the confluent passage of the first stage is supplied in the outer-circumferential passage of the second-stage blending apparatus, and water of 10 to 55 parts by volume is supplied in the inner tube for a unit time, and water of 10 to 30 parts by volume is further preferably supplied.

It is preferable that, in the third-stage blending apparatus, the entire amount of fluid dispersion ejected from the confluent passage of the second stage is supplied in the outer-circumferential passage of the second-stage blending apparatus, and further, water of 20 to 80 parts by volume is supplied in the inner tube for a unit time, and water of 25 to 45 parts by volume is further preferably supplied.

Further, it is preferable that the total amount of water supplied from the inner tube of the first to third-stage blending apparatuses for a unit time is 100 to 200 parts by volume, further preferably, 100 to 150 parts by volume with respect to a resin solution of 100 parts by volume, which is supplied in the outer-circumferential passage of the first-stage blending apparatus for a unit time, preferably, a resin solution with the resin solid content of which is 30 to 50 grams for 100 milliliter.

It is common that phase inversion is recognized in the second-stage or third-stage blending apparatus although depending on the supply amount of water in the respective stages.

As already described above, in a multi-stage blending apparatus, it is preferable that a blending mixer is provided between the ejection port of the blending apparatus of respective stages and the supply port of a blending apparatus of a subsequent stage.

(Aqueous Dispersion of Resin Particles)

A step of moving a hydrophobic solvent from an emulsified resin solution dispersion to a water phase is continuously carried out after the step of phase inversion emulsification, wherein it is possible to obtain aqueous dispersion of synthetic resin.

According to the phase inversion emulsifying method of the present exemplary embodiment, it is possible that the average particle size of a dispersed substance is preferably made approximately 100 to 150 nm, further preferably 100 to 200 nm. Also, according to the phase inversion emulsifying method, the particle size distribution of a dispersed substance may be narrowed in comparison with a general batch method, wherein the standard deviation in particle size may be kept in a narrow range from 1.1 to 1.3.

(Laminar Flow Formation)

It has been known that whether flows in the tube are made into a laminar flow or a turbulent flow is determined by whether or not the Reynolds number, which is a dimensionless number indicating a state of flow, is less than a specified critical value. That is, the smaller the Reynolds number becomes, the more the laminar flows are formed. The Reynolds number Re of flows in a tube is expressed by the following equation.

$$Re=D\langle v_x\rangle\rho/\mu$$

where D is an equivalent diameter, $\langle v_x\rangle$ is a means rate of a section, ρ is a density of a fluid, μ is a viscosity of the fluid. As has been understood from the above equation, since the smaller the equivalent diameter becomes, the smaller the Reynolds number becomes, stable laminar flows are likely to occur in a case of an equivalent diameter of μm size. In addition, the fluid properties such as density and viscosity influence the Reynolds number, wherein the Reynolds number becomes small in line with a decrease in density and an increase in viscosity, and laminar flows are likely to occur.

The Reynolds number showing the critical value is called the "critical Reynolds number." The critical Reynolds number is not necessarily fixed, the following values are roughly made into references.

Re<2,300 Laminar flows

Re>3,000 Turbulent flows 3,000>Re>2,300 Transient state

In the case of the blending method according to the exemplary embodiment, operation conditions are preferable, by which the Re number becomes less than 2,300 and laminar flows are formed in the confluent passage of the outer tube. Where a multi-stage blending apparatus is used, it is preferable that laminar flows are formed in the confluent passage of the outer tube of respective stages regardless of the size of the equivalent diameter of tubes.

EXAMPLES

Comparative Example 1

A glass tube that becomes an outer tube the inner diameter of which is 1,000 μm, and a fused silica capillary tube (produced by GL Sciences Inc.) that becomes an inner tube the outer diameter of which is 350 μm and the inner diameter of which is 250 μm are coaxially arranged so that a silica tube comes to the center of the glass tube. A micro-reactor operating as a blending apparatus is produced by assembling liquid chromatographic components, as shown in FIGS. 1A and 1B, so as to feed liquid A (water, static viscosity: 100 mPa·s) into the inner tube passage and liquid B (resin solution, static viscosity: 400 mPa·s) to the outer-circumferential space of the inner tube. The length of the silica tube inserted into the center of the glass tube is approximately 1 cm, the distal end of which is located at an intermediate position in the lengthwise direction of the outer tube the length of which is approximately 20 cm. Also, the distal end of the inner tube is cut perpendicularly to the length direction and is cut open to be circular. Fixed quantity feeding of liquids into the inner tube and the outer tube is carried out by using a syringe pump.

In regard to liquid feeding to the micro-reactor, liquid A (distilled water) is fed to the inner tube side at a rate of approximately 15 ml per minute, and simultaneously liquid B (resin solution) is fed into the outer-circumferential passage between the inner tube and the outer tube at a rate of approximately 8 ml per minute. As a result, resin is deposited and blocks the terminal of the inner tube.

Also, as the resin solution, a solution in which polyester resin is dissolved in an organic solvent which is a mixture solution of methyl ethyl ketone (MEK) and isopropyl alcohol (the mixing ratio by volume of which is 8:1.25) is used. The resin concentration in the resin solution is 45 grams for 100 milliliter.

Example 1

The configuration of the blending apparatus shown in FIGS. 1A and 1B are modified to produce a blending apparatus in which the opening port at the terminal of the inner tube is blocked, and a through hole as shown in FIG. 2D is provided so as for a fluid to flow out in the perpendicular direction of the center axis of the inner tube in the vicinity of the distal end of the inner tube. The distal end of the fused silica capillary tube, which is the inner tube, is sealed with the same material of the tube and the through holes, which are circular and have a diameter of 130 μm are provided by six in two stages in total in the vicinity of the distal end. The through holes are disposed three by three in two stages (alternately, up and down) so that the centers thereof are located equidistantly in the section perpendicular to the center axis of the inner tube.

The liquids A and B the compositions of which are the same as those of the Comparative Example 1 are supplied to the blending apparatus at the same rate in either case. As a result, O/W type fluid dispersion is continuously obtained without resin deposited at the terminal of the inner tube.

Example 2

As schematically shown in FIG. 3, blending apparatuses (micro-reactors) connected in series in three stages are produced. The temperature thereof is adjusted so that the entirety of the blending apparatuses is kept at approximately 40° C.

In the first-stage blending apparatus, distilled water A is fed into the inner tube passage at a rate of approximately 8 ml per minute, and the same resin solution B as that of the Comparative Example 1 is fed into the outer-circumferential passage at a rate of approximately 15 ml per minute, wherein the mixture solution thus obtained is made into liquid C.

Subsequently, in the second-stage blending apparatus, liquid C is fed into the outer-circumferential passage at a rate of approximately 23 ml per minute, and distilled water is fed into the inner tube passage at a rate of approximately 2 ml per minute, wherein the mixture solution thus obtained is made into liquid D.

Continuously, in the third stage, liquid D is fed into the outer-circumferential passage at a rate of approximately 25 ml per minute, and distilled water is fed into the inner tube passage at a rate of approximately 5 ml per minute. Aqueous dispersion medium of resin particles is obtained as the mixture solution.

Example 3

In the blending apparatus shown in FIG. 3, a micro hi-mixer module (5-element) (produced by Toray Engineering, Co., Ltd.) operating as a static in-tube mixer is connected between the outer tube ejection port of the first-stage blending apparatus and the outer tube supply port of the second state blending apparatus. The micro hi-mixer module is also connected between the second-stage blending apparatus and the third-stage blending apparatus to produce three staged blending apparatus. The temperature of the entire blending apparatus is adjusted at approximately 40° C.

Distilled water A is fed into the first stage inner tube passage at a rate of approximately 8 ml per minute, and a resin solution B is fed into the outer-circumferential passage at a rate of approximately 15 ml per minute, wherein the mixture blended in the first stage is made into liquid C.

Continuously, in the second stage, liquid C is fed into the outer tube passage at a rate of approximately 23 ml per minute, and distilled water is newly fed into the inner tube passage at a rate of approximately 2 ml per minute, wherein the mixture thus obtained is made into liquid D.

Subsequently in the third stage, liquid D is fed into the outer tube passage at a rate of approximately 25 ml per minute, and distilled water is fed into the inner tube passage at a rate of approximately 5 ml per minute. An aqueous dispersion medium of resin particles is obtained from the ejection port of the third-stage blending apparatus.

Comparative Example 2

Production of Aqueous Dispersion Medium

A resin solution of approximately 17 grams, which is the same as that used in Examples 2 and 3, is put in a vessel, and an aqueous dispersion medium of resin particles is obtained by blending and agitating while dropping distilled water therein at a rate of approximately 15 ml per minute (approximately 800 ml per hour).

With respect to the aqueous dispersion of resin particles, which is obtained by Examples 2, 3 and Comparative Example 2, the center particle size ($D_{50}$) (unit: nm) and the standard deviation of the particle size (volume average particle size distribution index GSDv) are evaluated, and the results thereof are shown as follows.

TABLE 1

| | $D_{50v}$ (nm) | GSDv |
|---|---|---|
| Example 2 | 135 | 1.25 |
| Example 3 | 110 | 1.18 |
| Comparative Example 2 | 198 | 1.56 |

It is found that an aqueous dispersion of resin particles with smaller center particle size and smaller standard deviation is provided in blending by the blending apparatus according to Examples 2 or 3 than in blending by the vessel according to Comparative Example 2.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A blending system, comprising:

two or more blending apparatuses, the blending apparatuses being connected to one another, the blending apparatuses including first blending apparatus and second blending apparatus, each including:

an outer tube; and at least one inner tube disposed inside the outer tube, wherein a distal end, in a lengthwise direction, of the inner tube is located at an intermediate position, in a lengthwise direction, of the outer tube, and the inner tube has a plurality of through holes in a vicinity of the distal end thereof; and a liquid feeding unit that feeds a fluid to an inner tube passage of the inner tube of the first blending apparatus and to an inner tube passage of the inner tube of the second blending apparatus, wherein an outer tube ejection port of the outer tube of the first blending apparatus is connected to an outer tube supply port of the outer tube of the second blending apparatus.

2. The blending system according to claim 1, further comprising:

a blending mixer that is disposed between the outer tube ejection port of the first blending apparatus and the outer tube supply port of the second blending apparatus.

3. A blending method, comprising:

feeding an organic solvent solution of a resin to an outer-circumferential passage located between the outer tube and the inner tube of the first or second blending apparatus according to claim 1;

feeding a water-soluble solution into an inner tube passage of the inner tube of the first or second blending apparatus to obtain a water-in-oil type fluid dispersion in a confluent passage of the first or second blending apparatus to which the outer-circumferential passage and the inner tube passage merge.

4. A blending method using the blending system according to claim 1, wherein the blending apparatuses of the blending system include first to Nth blending apparatuses which are coupled in sequence where N is an integer lager than 1, the method comprising:

feeding an organic solvent solution of a resin to an outer-circumferential passage located between the outer tube and the inner tube of the first blending apparatus;

feeding a water-soluble solution into the inner tube passage of the first blending apparatus to obtain a water-in-oil type fluid dispersion in a confluent passage of the first blending apparatus to which the outer-circumferential passage and the inner tube passage merge;

feeding a water-in-oil type fluid dispersion ejected from a confluent passage of the (N−1)th blending apparatus to an outer-circumferential passage of the Nth blending apparatus;

feeding a water-soluble solution to an inner tube passage of the Nth blending apparatus; and inverting a phase of the water-in-oil type fluid dispersion in a confluent passage of the Nth blending apparatus to obtain an oil-in-water type fluid dispersion.

5. The blending method according to claim 4, further comprising:

extracting an organic solvent from the oil-in-water type fluid dispersion obtained from the (N−1)th blending apparatus to obtain an aqueous dispersion of resin particles from the confluent passage of the Nth blending apparatus.

* * * * *